US005924680A

United States Patent [19]

Sicking et al.

[11] Patent Number: 5,924,680

[45] Date of Patent: Jul. 20, 1999

[54] FOUNDATION SLEEVE FOR A GUARDRAIL SYSTEM

[75] Inventors: Dean L. Sicking; John D. Reid; John R. Rohde, all of Lincoln, Nebr.

[73] Assignee: Safety By Design, Inc., Lincoln, Nebr.

[21] Appl. No.: 09/063,515

[22] Filed: Apr. 21, 1998

Related U.S. Application Data

[62] Division of application No. 08/832,422, Apr. 2, 1997, Pat. No. 5,775,675.

[51] Int. Cl.[6] ..... A01K 3/00

[52] U.S. Cl. ..... 256/13.1; 256/59; 404/6

[58] Field of Search ..... 256/13.1, 1, 59, 256/65, DIG. 5; 404/6, 9; 403/2; 52/165, 298, 170, 726.3, 726.4

[56] References Cited

U.S. PATENT DOCUMENTS

| | | | |
|---|---|---|---|
| 1,101,307 | 6/1914 | McDonough | 52/298 |
| 5,425,593 | 6/1995 | Buehler | 256/13.1 |

*Primary Examiner*—Lynne Reichard
*Assistant Examiner*—David Bochna
*Attorney, Agent, or Firm*—Miller, Sisson, Chapman & Nash, P.C.

[57] ABSTRACT

A highway guardrail terminal system having horizontally extending guardrail elements mounted on a plurality of posts. Foundation sleeves having an elongated slit along one side retain and support appropriate guardrail posts. A plurality of stiffing ribs extend across the slit at a distal portion of the tube. The sleeves enable a safer and faster removal of broken guardrail posts after vehicular impact.

1 Claim, 3 Drawing Sheets

FOUNDATION SLEEVE FOR A GUARDRAIL SYSTEM

This application is a divisional application of U.S. patent application Ser. No. 08/832,422, filed Apr. 2, 1997, now U.S. Pat. No. 5,775,675, and incorporated herein for all purposes.

BACKGROUND OF THE INVENTION

The present invention relates to an improved foundation sleeve for use with highway guardrail systems.

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET), and the slotted rail terminal (SRT).

In all of these systems, the first (or end) and the second posts are typically breakaway wooden posts inserted in foundation tubes to provide the necessary anchorage capacity and to ensure proper breakaway oft he posts. Additional breakaway posts with foundation tubes are also used with some terminals to facilitate easier maintenance and repair after impacts by errant vehicles. Field experience has shown that broken or severed posts after an impact are sometimes difficult to remove from the foundation tube due to swelling of the wooden posts. The present invention includes unique elongated foundation sleeve for retaining and supporting appropriate posts within the system while providing easy removal and replacement of broken or severed posts after an impact.

SUMMARY OF THE PRESENT INVENTION

The present invention cooperates within a highway guardrail or crash attenuation system which comprises a horizontally extending guardrail mounted on a plurality of vertically extending rail posts. The guardrail is mounted, along a vertical axis, to the posts. An impact head terminal member is slidingly positioned at a first end over the guardrail. The back end of the impact head is provided with an engaging plate which is designed to generally receive the engagement of an impacting vehicle. At the front end of the impact head, an inlet is provided to receive the leading end of the guardrail. A guide tube is attached to the inlet to guide the guardrail into the inlet. Further, attached at the inlet is a kinker beam which cooperates with a kinking deflector plate rigidly attached within and extending transversely across the head to generate kinks, or plastic hinges, in the rail element at discrete locations along the guardrail. The deflector plate is provided with a multiplicity of discrete, intersecting, angular faces upon which the rail element impacts as the impact head is horizontally displaced along the guardrail upon engagement of an impacting vehicle.

An anchor cable release bracket with tapered slots along a first side and enlarged openings along an opposite side is provided. The bracket is attached to the rail element by sleeved mounting bolts. The bracket is shifted laterally and then one side is forced away from the rail element and off of the mounting bolts upon impact of the guide tube.

Foundation sleeves of the present invention have an elongated slit along one side of the sleeve with stifling ribs extending across the slit to retain and support the guardrail posts. The elongated slits in the sleeve allow the sleeve to expand when the wood post swells due to moisture. The ability for the sleeve to expand outward facilitates removal of the post after a vehicular impact. The elongated slits also simplify the fabrication of the foundation sleeve by reducing the amount of welding and minimizing warping of the sleeve during the welding process.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
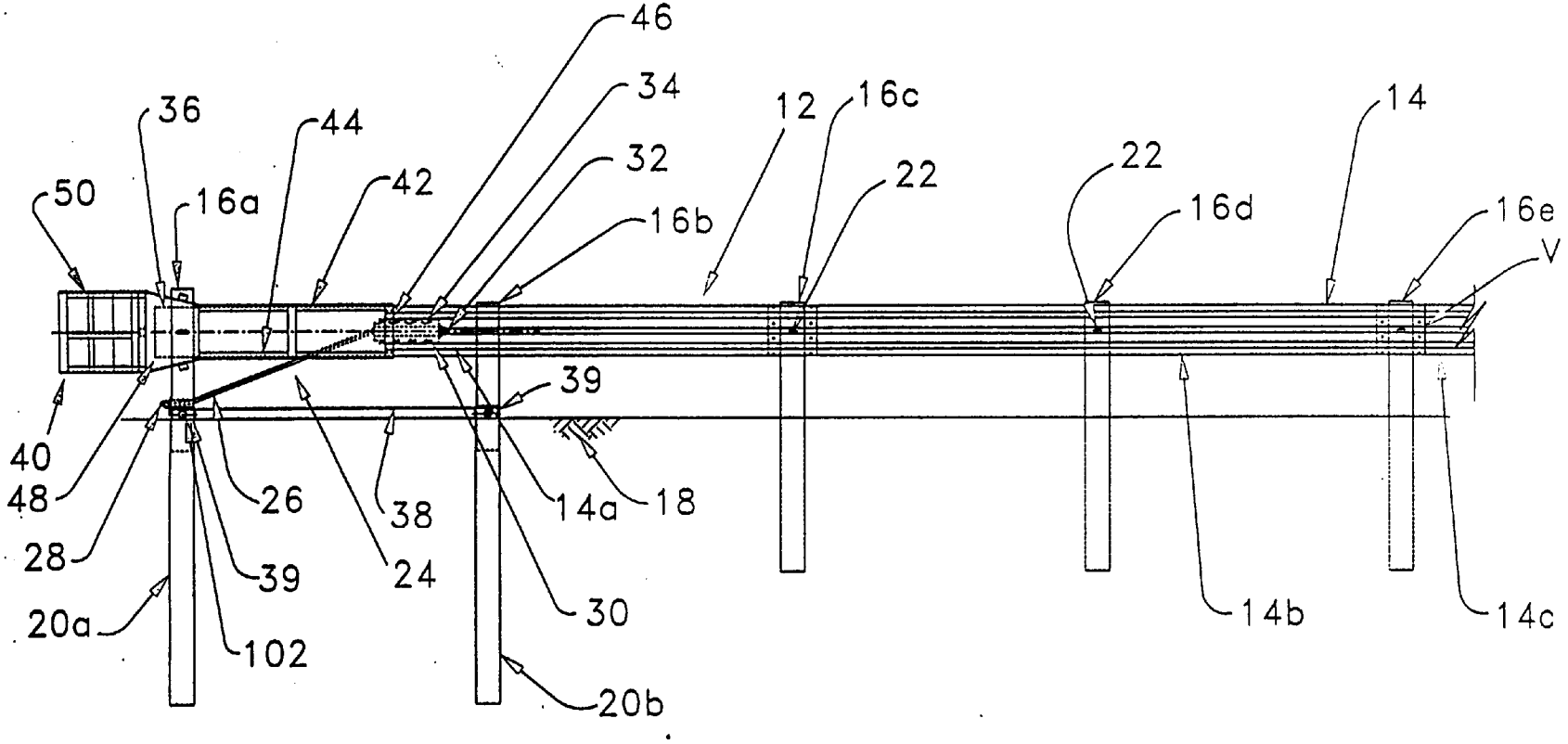
FIG. 1 illustrates a side elevation view of a first embodiment of the present inventive highway guardrail terminal system.

Referring now to the drawings, and more particularly to FIG. 1, the reference numeral (12) generally represents an energy dissipating guardrail terminal using the sequential kinking concept. The terminal which is adapted to be connected to the upstream side of a conventional guardrail (14) consisting of standard W-beam guardrail sections, either approximately 12'6" or 25' in length. The guardrail sections or rail elements **(14*a*–14*c*) are attached along their vertical axes (V) by bolts (22) to a plurality of vertical breakaway posts (16*a*–16*e*) spaced apart approximately 6'3" from each other. It should be understood that the sequential kinking terminal is effective with other spacing distances. Any suitable number of posts may be used depending upon the expanse of the guardrail run. FIG. 1 illustrates five wooden breakaway posts. Wooden posts (16*c*–16*e*) are shown embedded directly into the soil (18). Lead post (16*a*) and second post (16*b*), which are shorter in length than the other posts, are shown inserted within unique foundation sleeves (20*a* and 20*b*)** of the present invention.

FIG. 1 further illustrates an anchor cable mechanism (24) which includes an anchor cable (26), lower anchor cable bolt (28), a unique and novel anchor cable release bracket (30), an upper anchor cable bolt (32), and eight unique and novel sleeved bolts (34). The anchor cable mechanism is provided to allow the terminal (12) to withstand angular vehicle impacts downstream of its upstream end (36). In addition, a ground strut (38) having a U-shaped yoke (39) on each end extends between the first and second posts and is provided for additional support for the anchor cable forces. A bolt or fastener (102) extends through the yoke and the post to secure the strut in place.

It is intended that a vehicle will impact the guardrail (14) downstream of its upstream end (36); however, a collision with the end (36) requires the provision of an end treatment designated by reference numeral (40) to reduce the extent of injury to the impacting vehicle and its occupants. The purpose of the end treatment (40) is to dissipate impact energy of the vehicle.

Figure 2:
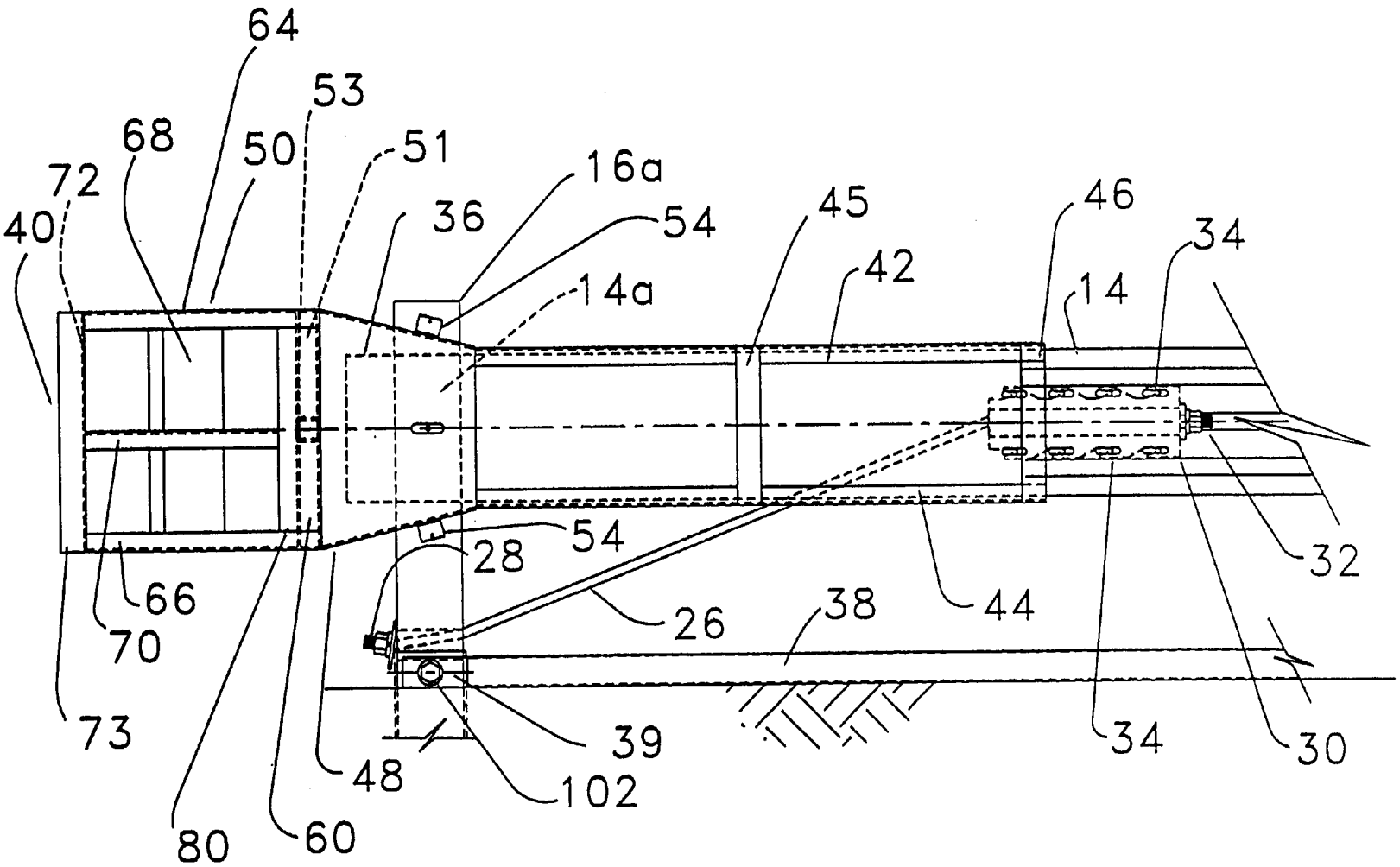
FIG. 2 illustrates a side elevation view of the impact head, guide tube, and cable release mechanism of the present invention.

FIG. 2 illustrates a side view of the end treatment (40). The end treatment (40) includes top guide rail (42), bottom guide rail (44), center guide rail strap (45), end guide rail straps (46), guide tube (48), impact head (50) and kinker beam (51). The impact head (50) is attached on the upstream end of guide tube (48). Guide tube (48) is mounted onto lead post **(16*a*) by fasteners (52) passing through post angle brackets (54). The upstream end (36) of the rail element (14*a*) extends into the guide tube (48)**.

It may be seen that the top (42) and bottom (44) guide rails extend downstream along and above the upper and lower edges of the guardrail (14), respectively. Guide straps (45 and 46) maintain the top and bottom guide rails in spaced apart relation. The guide rails ensure that the W-beam rail (14) is guided properly into the guide tube (48) and impact head (50) without the impact head (50) or guide tube (48) rotating or twisting as the end treatment (40) moves down the length of the W-beam rail (14) during a collision.

Figure 3:
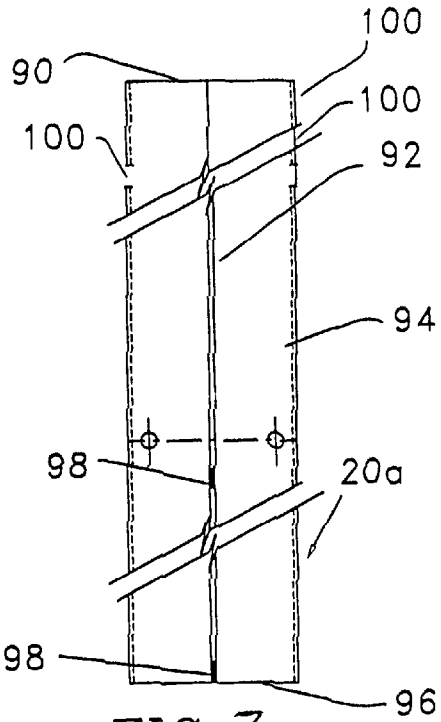
FIG. 3 illustrates a side elevation view of the foundation sleeve of the present invention.

Impact head (50) has an inlet (60) and an outlet (62) (FIG. 3). A top plate (64), and a bottom plate (66), house a sequential deflector plate (68), a support gusset (70), and a front impact plate (72). At the inlet (60), the kinker beam (51) is attached to the top plate (64) and the bottom plate (66) and spaced apart from the first deflector face (80) of deflector plate (68). The kinker beam (51) is a 20"×2"×2" steel box tube but any comparable sizing may be used.

It is through this inlet (60) (which is about 4" wide) between the first deflector face (80) and the kinker beam (51) that the W-beam rail element (which is about 3" wide) passes when the impact head (50) is displaced downstream along rail (14) during collision.

Extending generally perpendicular from the side of kinker beam (51) is a 6"×2"×2" box tube, post breaker (53). The post breaker beam (53) is welded to the kinker beam (51) and extends outwardly approximately 6" from the side of the kinker beam. Other suitable dimensions may be used. However, the length of the post breaker beam (53) is sufficient to extend the full width of the wood post **(16*a*). The post breaker beam (53) is also generally perpendicular to the vertical axis (V) of the W-beam and is designed to engage and break the lead post (16*a*) when the impact head (50)** is displaced downstream in a collision.

Post **(16*a*) is provided with a 2 ½" diameter hole through which passes a portion of the anchor cable (26). The hole is positioned slightly above the yoke (39) of strut (38). When the impact head is displaced downstream in a collision, the post breaker beam engages the full width of post (16*a*) and post (16*a*) will snap or break at the hole in the post. By having the beam (53) extend the full width of the post (16*a*), the tests have shown that the post (16*a*) more easily and cleanly breaks just above the yoke (39)** at the anchor cable hole.

The sequential kinking concept entails dissipation of the kinetic energy of the impacting vehicle through kinking of the rail element (14). When the end treatment (40) is impacted end-on by an errant vehicle, the impact plate (72) will engage and interlock mechanically with the front of the vehicle. As the vehicle proceeds forward, the impact head (50) will be moved forward or downstream along the rail element (14). The post breaker beam (53) on the side of the kinker beam (51) will contact and break off the first or lead breakaway wooden post **(16*a*), thus releasing the tension on the cable (26) of the cable anchorage system (24)**.

At or shortly after breaking of the lead post **(16*a*), the end (36) of the rail element (14*a*) will contact the deflector plate (68) within the impact head and kink the rail element (14*a*)**.

The kinked section will eventually exit the impact head (50) through outlet (62) on the backside of the impact head (50) away from the traffic.

Figure 4:
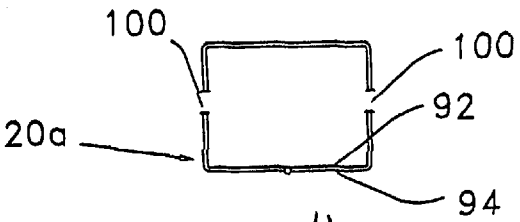
FIG. 4 illustrates a top view of the foundation sleeve of the present invention.

The first two posts **(16*a* and 16*b*) are received at one end into the top or proximal end (90) of the elongated foundation sleeves (20*a* and 20*b*) of the present invention. FIGS. 3 and 4 show the structure of the foundation sleeve (20*a*). A plate of metal is bent to form the tube-like configuration of the sleeves; however, an elongated slit (92) extends along one side (94) of the sleeves from the proximal end (90) to the distal end (96). A plurality of stiffing ribs (98) are formed by providing a multiplicity of 2" welds across the slit (92)** along the distal two-thirds portion of the sleeve at space apart locations.

The sleeve is provided with post retaining bolt receiving orifice (100) which allows for a bolt (102) to pass through the sleeve and through the post **(16*a* or 16*b*) to retain the post in the sleeve. Further, the yoke (39) of ground strut (38) is fastened to the foundation sleeve by bolt (102). When a post is broken off in a collision with the guardrail system (12), the stub remaining in the sleeve may be easily removed from the sleeve by removing the bolt (102) and pulling the stub from the sleeve. The elongated slit (92) further facilitates the removal of a wet or swollen stub by allowing maintenance personnel to insert a tool in slit (92)** and increase the opening in the proximal end of the sleeve to remove the stub.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A foundation sleeve system for guardrail posts, a portion of said sleeve extending substantially below ground level comprising:

an elongated tube formed from a single plate of material having an opening in a proximal end for receiving a first end of said post, a portion of said proximal end extending above said ground level, said tube having an elongated slit along one side of said tube extending from said proximal end to a distal end, said distal end of said tube extending below said ground level, said portion of said proximal end above said ground level having a guard post retaining bolt orifice for accepting a retaining bolt passing through said orifice and said guardrail post to retain said guardrail post in said sleeve system, said slit has a plurality of stiffening ribs extending across said slit along a distal ⅔ portion of said tube which extends below said ground level.

* * * * *